US005656771A

United States Patent [19]

Beswick et al.

[11] Patent Number: 5,656,771

[45] Date of Patent: Aug. 12, 1997

[54] MOTOR VEHICLE COOLING SYSTEM STATUS INDICATOR

[75] Inventors: Desmond Edward Beswick, Robertson; Peter John Maritz, Benoni, both of South Africa

[73] Assignee: Besmarguage CC., Gauteng, South Africa

[21] Appl. No.: 613,203

[22] Filed: Mar. 6, 1996

[30] Foreign Application Priority Data

Mar. 20, 1995 [ZA] South Africa ..... 95/2255

[51] Int. Cl.[6] ..... B60Q 1/00; G01M 15/00

[52] U.S. Cl. ..... 73/118.1; 73/117.3; 340/449; 340/451; 374/145

[58] Field of Search ..... 73/113, 114, 115, 73/116, 117.2, 117.3, 118.1; 340/449, 451; 364/431.03; 374/145

[56] References Cited

U.S. PATENT DOCUMENTS

| | | | |
|---|---|---|---|
| 2,505,237 | 4/1950 | Dwyer | 73/113 |
| 2,553,526 | 5/1951 | Chapple et al. | 73/115 |
| 3,956,935 | 5/1976 | Ford | 73/118.1 |
| 4,630,028 | 12/1986 | Kelly et al. | 73/118.1 |
| 4,633,213 | 12/1986 | Venema | 73/118.1 |
| 4,663,608 | 5/1987 | Kelly | 73/118.1 |
| 4,682,493 | 7/1987 | Tenenbaum | 73/118.1 |

*Primary Examiner*—George M. Dombroske
*Attorney, Agent, or Firm*—Young & Thompson

[57] ABSTRACT

Disclosed is a method for monitoring the status of a motor vehicle engine cooling system including sensing the pressure and temperature of coolant in the cooling system, generating respective output signals, and processing the output signals to generate an indication of a coolant system fault condition when the pressure of the coolant falls below a preset limit in relation to the temperature of the coolant. Apparatus for performing the method is also disclosed. Several embodiments are disclosed for indicating a coolant system fault condition, such as adjacent gauges for visual comparison, summing of the signals to provide a combined output signal of temperature modified by pressure for display on a gauge, and/or comparing the signals to trigger a warning signal when the preset limit is exceeded.

18 Claims, 2 Drawing Sheets

MOTOR VEHICLE COOLING SYSTEM STATUS INDICATOR

FIELD OF THE INVENTION

This invention relates to monitoring the status of a motor vehicle engine cooling system and is concerned with methods and apparatus for indicating the true status of the cooling system and providing warning signals when the cooling system is defective.

BACKGROUND OF THE INVENTION

Most cars and the like have a temperature gauge to indicate engine coolant temperature and most of these are marked only with colors, typically blue for cold; yellow/orange/background for normal or safe range; and red for hot or danger. Unmarked and unnumbered scales are not uncommon. In use, most drivers check the temperature gauge very occasionally and as long as the indicating needle is not in the red zone assumes everything is fine in the cooling system. Often overheating of the engine occurs without being observed. However, more problematical and not uncommon is that engines can overheat due to cooling system faults that are not reflected by the gauge.

Modern vehicle engines depend upon a pressurised cooling system to raise the boiling point of engine coolant for increased combustion efficiency. Most modern cooling systems operate at a pressure of ±100 kPa at which pressure the boiling point is about 120° C. The red line on the temperature gauge in this event would be marked at ±115° C. The inventors have realized that anything which leads to loss of pressure in the cooling system from, say, a defective radiator pressure cap, low coolant level, leaking hoses, etc., will cause the boiling point of the coolant to drop to about 100° C., ie. the boiling point of water at atmospheric pressure. Unfortunately, at this temperature the temperature gauge indicates well below the danger zone. Thus the driver proceeds, often at high speed, blissfully unaware that anything is amiss until the engine stops unexpectedly, because the engine has seized or the cylinder head has cracked and warped.

SUMMARY OF THE INVENTION

One aspect of the invention provides a method of monitoring the status of a motor vehicle engine cooling system including the steps of: sensing the pressure and temperature of coolant in the cooling system; generating at least one of a pressure output signal and a temperature output signal, the signals respectively being representative of the sensed pressure and temperature; and processing the output signals to generate an indication of a coolant system fault condition when the pressure of the coolant falls below a preset limit in relation to the temperature of the coolant.

The temperature and pressure are not constant in practical driving situations, such as when going up or down hills or idling in traffic, nor do they change at the same rate under all conditions. Thus monitoring one or the other is not sufficient for all conditions. Monitoring both separately may be useful to some drivers, but is probably to be confusing or uninformative to most.

Thus one form of the invention includes displaying separate output signals of temperature and pressure adjacent to each other such that they can be observed and readily compared to indicate a coolant system fault condition.

Another form includes comparing the pressure and temperature output signals, generating a compared output signal at least when the pressure output signal exceeds a preset limit in relation to the temperature output signal, and generating the indication of a coolant system fault condition when the compared output signal has been generated.

Yet another form includes summing the pressure and temperature output signals to generate a combined output signal of one of the output signals modified by the other of the output signals, and indicating the combined output signal at least when the pressure output signal exceeds a preset limit in relation to the temperature output signal. Preferably the combined output signal is fed to a suitable display, which is calibrated such that it indicates the temperature of the coolant substantially normally when the coolant system is functioning normally and indicates excessively high temperatures when the pressure of the coolant falls below a predetermined limit in relation to the temperature of the coolant. Preferably an audible and/or visual warning signal is generated when a fault condition is indicated.

The method may include immobilizing the engine automatically following a preset time interval after generation of an indication of a coolant system fault condition.

Another aspect of the invention provides apparatus for monitoring the status of a motor vehicle engine cooling system comprising a coolant temperature sensor; a coolant pressure sensor; means for generating at least one of a pressure output signal and a temperature output signal, the signals respectively being representative of the pressure and temperature of the coolant; and means for indicating a coolant system fault condition when the pressure of the coolant falls below a preset limit in relation to the temperature of the coolant.

The apparatus may include display means for displaying the output signals of pressure and temperature adjacent to each other such that the displayed output signals can be observed and readily compared to indicate a coolant system fault condition. Additionally or alternatively the apparatus may include means for comparing the pressure and temperature output signals and generating a compared output signal when the pressure of the coolant falls below a preset limit in relation to the temperature of the coolant and means for applying the compared output signal to energise the indicating means when the compared output signal has been generated.

The apparatus may include means for summing the temperature and pressure sensor signals and providing a combined output signal indicative of the combined effect of one of the sensor signals modified by the other of the sensor signals, and means for applying the combined output signal to energise the indicating means to indicate an abnormally high temperature when the pressure in the coolant system falls below a preset limit in relation to the temperature of the coolant.

The apparatus may also include warning means and/or means for immobilizing the engine following a preset time interval after the pressure of the coolant has fallen below a preset limit in relation to the temperature of the coolant.

Yet another aspect of the invention provides a sensor device comprising a body defining a flow passage, the body being mountable in the flow path of coolant in a motor vehicle cooling system, and at least one sensor for sensing at least one of pressure, temperature and the presence of coolant in the cooling system.

Further features, variants and/or advantages of the invention will emerge from the following non-limiting description of examples of the invention made with reference to the accompanying schematic drawings.

Figure 1:
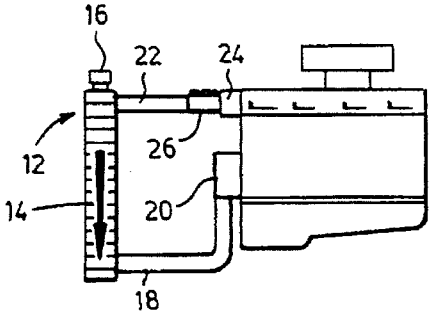
FIG. 1 shows a side view of a motor vehicle engine with a liquid coolant system and an example of apparatus of the invention.

DESCRIPTION OF PREFERRED EMBODIMENTS:

In the drawings the same or similar parts have the same reference numbers, except for the component numbers of the circuits of FIGS. 5 to 8.

FIG. 1 shows a side view of a motor vehicle engine 10 having a liquid coolant system 12 comprising a radiator 14, a radiator pressure cap 16, a lower water pipe 18 for connecting the bottom of the radiator to the coolant passages of the engine via a water pump 20, and an upper water pipe 22 for connecting the top of the radiator to the coolant passages in the engine via a thermostat switch 24. This is substantially conventional and thus will not be described further. The coolant is usually driven by the pump to flow downwardly through the radiator. A sensor mounting device 26 is connected into the coolant system in the upper water pipe 22.

Figure 2:
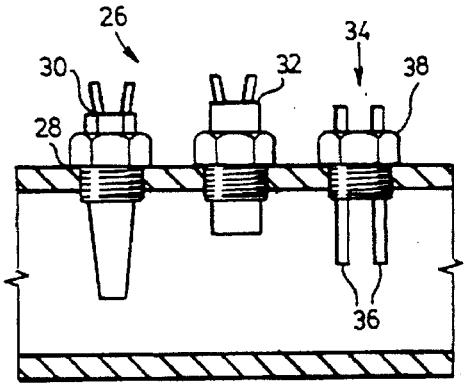
FIG. 2 shows a multiple sensor device of the cooling system of FIG. 1 in greater detail.

As shown in greater detail in FIG. 2, the sensor device 26 comprises a metal tube 28 sized to fit into the upper water pipe 22 at each end and a temperature sensor 30, a pressure sensor 32, and a coolant presence sensor 34 fitted to the tube. The tube 28 may also be of plastics. The temperature and pressure sensors are electrical resistance sensors of known type, the resistance of which is caused to change with changes in temperature and pressure, respectively. The coolant presence sensor 34 comprises two electrodes 36 mounted on a non-conductive housing 38 and arranged to project to about the centre of the tube 28. Coolant in the tube completes an electrical path between the electrodes.

Figure 3:
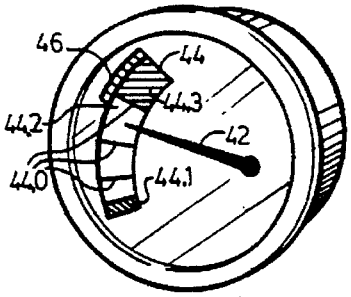
FIG. 3 shows an analogue gauge for displaying cooling system status to a driver.

FIG. 3 shows an analogue coolant temperature gauge 40 with an indicating needle 42, and a scale 44 marked with range markings 44, of which there is a blue or "cold" section 44.1, a medial "normal" section 44.2 and a red or "overheating" section 44.3. Fitted to the gauge is a digital scale of an arcuate array of light emitting diodes (LED's) 46 for indicating pressure.

Figure 4:
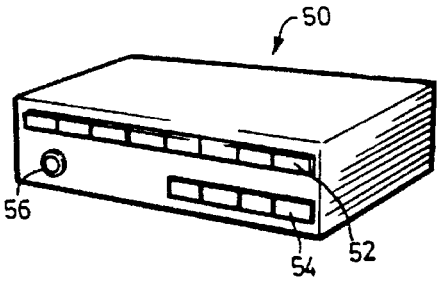
FIG. 4 shows a digital display device for displaying cooling system status to a driver.

FIG. 4 shows a digital display device 50 with a linear array of LED's 52 for indicating temperature, a linear array of LED's 54 for indicating pressure and a single LED 56 for indicating the presence of coolant.

Figure 5:
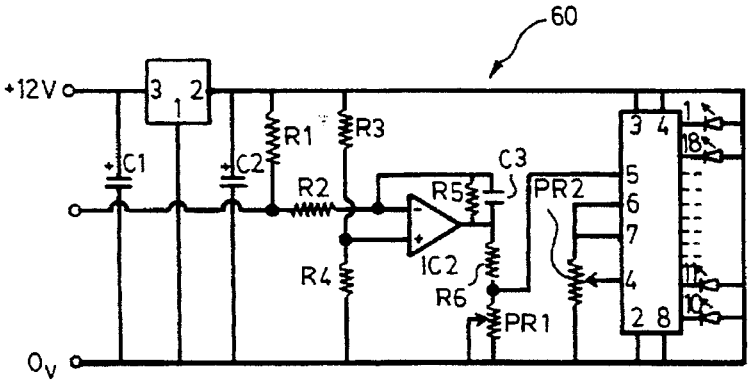
FIG. 5 shows a circuit diagram for evaluating a sensor signal and for driving a digital display.

FIG. 5 shows a diagram of a circuit 60 for evaluating a sensor signal and driving a digital display, the same circuit being usable for pressure and temperature. Circuit 60 comprises integrated circuit IC1 functioning as a voltage regulator that provides a stable supply voltage for the circuit regardless of fluctuations of the battery voltage in the vehicle. A current source for a sensor is provided via resistor R1. The subsequent voltage that develops across the sensor is fed via resistor R2 to an inverting input of an operational amplifier IC2, code type 741. IC2 inverts this signal by comparing it to the reference provided by resistors R3 and R4. The output of IC2 is thus a voltage signal that is inversely proportional to a resistance that develops across the sensor as the pressure or temperature varies. This voltage is fed to the input of IC3, which is an LM3914 LED bar graph display driver. Potentiometer PR1 provides a range or span adjustment for the LED bar graph display driver and potentiometer PR2 provides a zero adjustment. The range of the two display driver inputs can thus be varied to indicate a wide range of both temperature and pressure inputs. Typically these would be a temperature range of 40° to 140° C. (about 104° to 284° F.) and pressure range of 0 to 200 kPa (about 0 to 29 psi).

Figure 6:
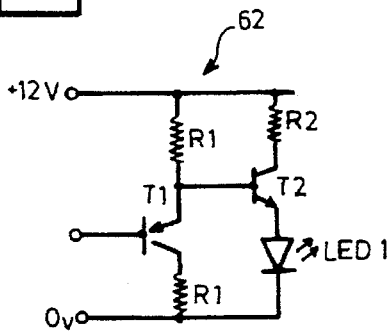
FIG. 6 shows a circuit diagram of a switch for detecting the presence of coolant and issuing a suitable warning signal.

FIG. 6 shows a coolant detector switching circuit 62 consisting of two transistors T1 and T2, two resistors R1 and a light emitting diode LED1. The circuit functions as follows. With coolant present in the system the base of transistor T1 is set at earth potential via a detector switch, such as the coolant presence sensor 34. T1 is thus turned "on" which in turn sets the base of transistor T2 to earth potential via T1, so that T2 is set "off". If coolant is not present T1 is set "off", setting T2 "on" due to its base being at the positive voltage of the electrical supply via resistor R1, so that LED1 is energised to indicate insufficient coolant within the cooling system.

The combination of the three circuits and sensors described above is able to detect and indicate a wide range of faults that could occur in the cooling system of any type of motor vehicle as discussed below.

The combination of the pressure and temperature indicators which are positioned adjacent each other, as illustrated in FIGS. 3 and 4, can now be combined to determine the status of the cooling system when the water in the radiator has reached boiling point. The displays are arranged so that pressure and temperature are displayed inversely. For example with the analogue gauge of FIG. 3, the needle 42 rises with increasing temperature and the LED's of the pressure display illuminate from the top of the scale downwardly with decreasing pressure. With the digital displays of the gauge of FIG. 4, the temperature LED's illuminate from left to right with increasing temperature, while the pressure LED's illuminate from right to left with decreasing pressure. Thus as temperature and pressure rise, more temperature LED's illuminate or the needle moves upwardly, while the pressure LED's go off sequentially.

In use, with the ranges properly zeroed and ranges set, the adjacent displays do not intersect or overlap under normal conditions. For example as temperature rises from cold, the pressure will also rise, so that as the temperature indicators increase the pressure indicators decrease in a direction away from the increasing temperature indicators. Thus if all is in order the pressure and temperature indicators will not intersect or overlap, although they may vary depending on driving conditions.

The system will indicate fault conditions as follows:

If the pressure drops, say by loss of coolant, a faulty radiator cap, holed radiator or radiator hose or any other fault that could cause a loss of pressure within the cooling system, then the temperature and its indicator would stay at the same level, usually at ±100° C. when the water boils at atmospheric pressure and which is still in the "normal" range of the gauge. However, in this event the pressure indicator will show a drop in pressure and the LED's will illuminate sequentially until they overlap the temperature indicator. The driver is thus alerted to a problem.

If the water does not circulate because of a faulty water pump, blocked radiator, etc., then the temperature indicator will rise or increase, while pressure will remain constant or be out of the range, again alerting the driver to a problem.

If there is a loss of coolant, then this will be indicated by LED 56 in FIG. 4 and by a suitable buzzer, not illustrated.

Figure 7:
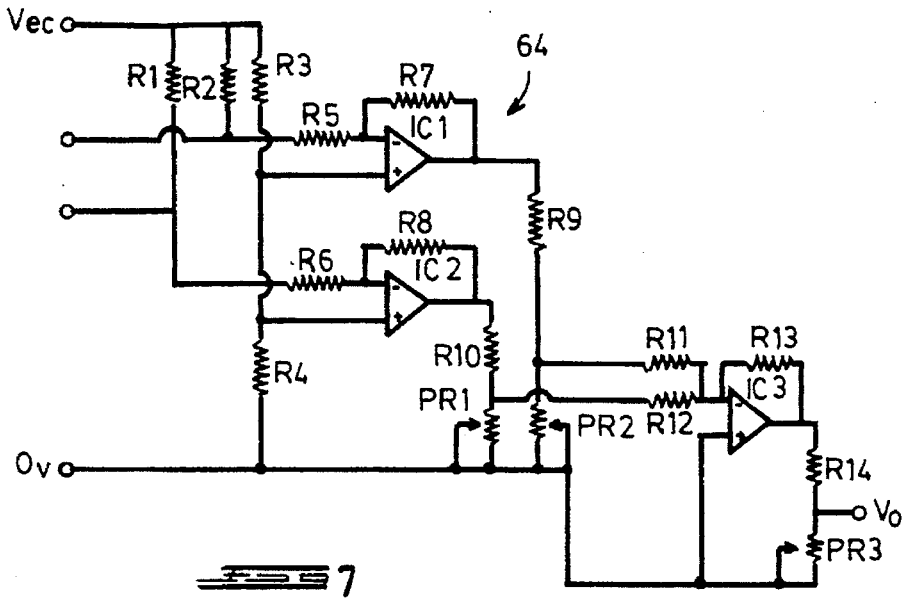
FIG. 7 shows a diagram of a circuit for summing temperature and pressure signals.

FIG. 7 shows a circuit for summing temperature and pressure signals to provide a temperature reading modified by pressure. It may be used with existing temperature gauges and sensors of motor vehicles in conjunction with a pressure sensor 32 is fitted to the vehicle. This system may be used with audio/visual indicators and a coolant presence sensor.

The summing circuit 64 has resistors R1 to R13, potentiometers PR1 to PR3 and integrated circuits or operational amplifiers IC1 to IC3 arranged as shown in the drawing and functions as follows. Integrated circuits IC1 and IC2 monitor the output voltage readings from temperature and pressure sensors, respectively, and generate output signals that are proportional to the temperature and pressure output voltages. The output signals pass to a voltage summing circuit including IC3, such that as the pressure decreases an increasingly higher voltage signal is added to the temperature signal. The output of the circuit at terminal Vo can then be fed to any type of indicator ie. bar-graph, moving coil meter, etc. The result of the circuit is a pressure corrected temperature signal, ie. if the pressure decreases Vo increases whereby the voltage fed to the indicator will increase. Potentiometers PR1 and PR2 are provided to zero the display and provide a suitable relationship between the values of the pressure and temperature signals so that existing gauges can be used.

In use, assuming a temperature gauge is red lined at 120° and the coolant is operating at 100° C. at ±100 kPa, then the gauge needle would indicate in the safe zone. Should the pressure drop, such as to atmospheric, for any reason, then the needle would move to red indicating boiling point and alert the driver.

Figure 8:
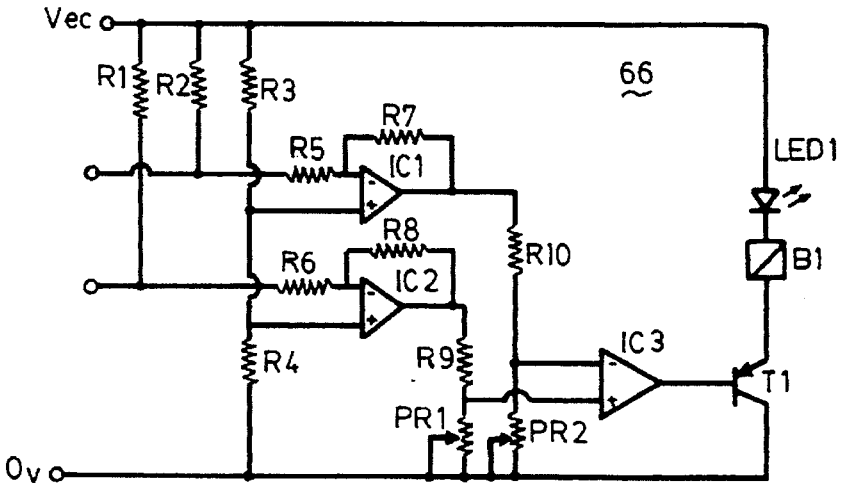
FIG. 8 shows a diagram of a circuit for comparing temperature and pressure signals.

FIG. 8 shows a circuit 66 to compare temperature and pressure signals and activate an alarm when a relationship between coolant temperature and pressure exceeds a preset limit. Circuit 66 comprises resistors R1 to R10, potentiometers PR1 and PR2, integrated circuits or operational amplifiers IC1 to IC3, transistor T1, a buzzer B1 and a light emitting diode LED1 arranged as shown in the drawing and functions as follows. In this circuit the voltages developed across the pressure and temperature sensors via resistors R1 and R2 are fed to inverting amplifiers IC1 and IC2 which provide output voltages proportional to the temperature and pressure within the cooling system. The two output voltages are fed via R9/PR1 and R10/PR2 to IC3 operating as a voltage comparator. The output of IC3 switches transistor T1 "on" or "off" and thereby selectively energising buzzer B1 and LED1. PR1 and PR2 are again used to set the switching point of the circuit, such as at 100° C. and 0 kPa. The result is that if the relation between temperature and pressure within the cooling system is not within preset limits, then a fault condition is indicated by the buzzer and LED.

Figure 9:
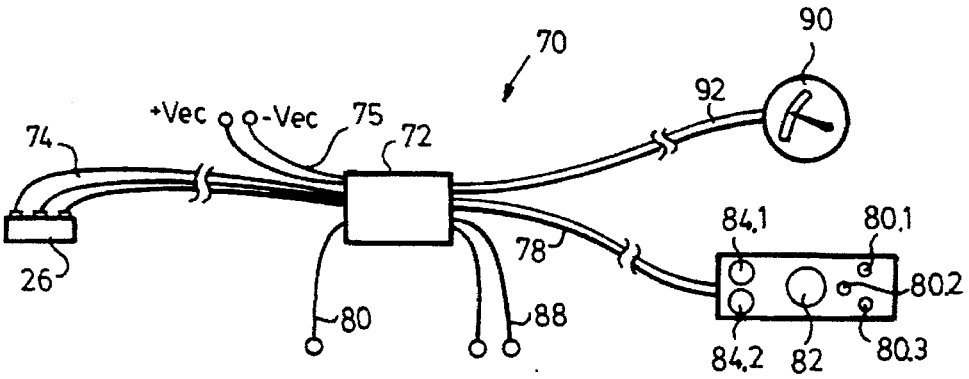
FIG. 9 shows components of a monitoring apparatus of the invention.

FIG. 9 shows schematically a monitoring apparatus 70 of the invention comprising an electronic circuit 72 (including circuits 62, 64 and 66 described above) contained in a housing for processing signals from the pressure, temperature and coolant presence sensors connected via a set of leads 74, and an indicating device 76 connected to the circuit 72 via leads 78. Buzzer B1 of circuit 66 is also connected in series with LED1 of circuit 62. A pair of power supply leads 75 extend from the circuit for connection to a motor vehicle's power supply and earth. The indicating device has a green LED 80.1, a red LED 80.2 and a yellow LED 80.3 for identifying the nature of a cooling system fault and a buzzer 82. The buzzer and LED's are energised by the circuit depending on the status of the cooling system as described above. Actuating the test button tests that the sensors, LED's and buzzer are functioning. Spare leads 86 and 88 are connected to the circuit 72. Lead 86 is connectable to an oil pressure switch, not shown, and is connected to circuit 66 to trigger comparator IC3 through a detector switching circuit 62 as shown in FIG. 5. Lead 88 is connectable to an engine immobilizing device, also not shown, and as known in the art, the lead being connected to circuit 66 at the output of IC3 or transistor T1 according to the output voltage and current desired as a trigger for the immobilizer. The immobilizing device may act on either or both of the ignition circuit and fuel supply system as is known in the art. Leads 92 connect the output of the summing circuit 64 to a temperature gauge 90 to provide a visual display of coolant temperature modified by the inverse of coolant pressure.

In practice the circuit 72 is installed in the engine compartment or under the dashboard of a motor vehicle and the indicating device installed on the dashboard at a location suitable to be visible to a driver. In use the apparatus functions as follows. If all is in order, then the green LED is on. If the temperature rises above boiling point or, for testing, the sensor is shorted to the vehicle's chassis, then the yellow LED illuminates and the buzzer sounds. If there is no or insufficient coolant or, for testing, the coolant presence sensor is disconnected, then the red LED illuminates and the buzzer sounds. The shorting and disconnecting may be performed manually or by actuating test buttons 84.1 and 84.2 on the indicating device. Temperature gauge indicates temperature substantially normally, except when the coolant temperature is below that at which coolant would boil in which event it displays an excessively high temperature to notify the driver that something is amiss in the coolant system.

The invention is not limited to the precise details described above and shown in the drawings. Modifications may be made and other embodiments developed without departing from the spirit of the invention. For example, the gauge, display and circuits may be used and interchanged and combined as desired. Also the output of IC3 of circuit 66 of FIG. 8 can be applied to control a relay to disable or immobilise an engine automatically if the coolant system is faulty, perhaps after a short delay after issuing a warning signal. Also the temperature sensor shown in FIGS. 1 and 2, may be placed in the conventional position, ie. immediately before the thermostat switch. The sensors 30 and 32 can also each be single terminal units having an electrical circuit completed through a metal tube 28, which is connected to earth. In this event, the coolant presence sensor 34 would have only one electrode projecting into tube 28. The pressure sensor described above senses pressure and generates a signal representative of the value of the pressure, but it may be replaced by a pressure sensitive switch which switches from open to closed or vice versa at a particular pressure, say at 30 kPa. The warning and indicating lights may be the same or different, such as a bright red light to show a fault has occurred and separate LED's, optionally of different colors, to indicate the nature of the fault, ie. no coolant, no pressure, no oil, high temperature.

The claims form an integral part of the specification.

We claim:

1. A method of monitoring a status of a motor vehicle engine cooling system including the steps of: sensing pressure and temperature of coolant in the cooling system; generating at least one of a pressure output signal and a temperature output signal, the output signals respectively being representative of the sensed pressure and temperature; and processing the output signals to generate an indication of a coolant system fault condition when the pressure of the coolant falls below a coolant pressure limit in relation to the temperature of the coolant by displaying separate output signals of temperature and pressure adjacent to each other such that the displayed output signals can be observed and readily compared to indicate a coolant system fault condition, the output signals being displayed such that they move in opposite directions with increasing temperature and decreasing pressure and overlap when the coolant pressure limit is exceeded.

2. A method of monitoring a status of a motor vehicle engine cooling system including the steps of: sensing pressure and temperature of coolant in the cooling system; generating at least one of a pressure output signal and a temperature output signal, the output signals respectively being representative of the sensed pressure and temperature; and processing the output signals to generate an indication of a coolant system fault condition when the pressure of the coolant falls below a coolant pressure limit in relation to the temperature of the coolant by summing the pressure and temperature output signals to generate a combined output signal of one of the output signals modified by the other of the output signals, and indicating the combined output signal at least when the pressure output signal exceeds a pressure output signal limit in relation to the temperature output signal.

3. The method of claim 2, wherein the display indicates the temperature of the coolant and is calibrated such that it indicates the temperature of the coolant substantially normally when the coolant system is functioning normally and indicates excessively high temperatures when the pressure of the coolant falls below a predetermined limit in relation to the temperature of the coolant.

4. An apparatus for monitoring a status of a motor vehicle engine cooling system comprising a coolant temperature sensor; a coolant pressure sensor; means for generating at least one of a pressure output signal and a temperature output signal, the signals respectively being representative of pressure and temperature of the coolant; means for indicating a coolant system fault condition when the pressure of the coolant falls below a coolant pressure limit in relation to the temperature of the coolant, the indicating means including display means for displaying the output signals of pressure and temperature adjacent to each other such that the displayed output signals can be observed and readily compared to indicate a coolant system fault condition, the display means for pressure and temperatures being arranged such that the displayed output signals overlap when the coolant pressure limit is exceeded.

5. An apparatus for monitoring a status of a motor vehicle engine cooling system comprising a coolant temperature sensor; a coolant pressure sensor; means for generating at least one of a pressure output signal and a temperature output signal, the signals respectively being representative of pressure and temperature of the coolant; means for indicating a coolant system fault condition when the pressure of the coolant falls below a coolant pressure limit in relation to the temperature of the coolant; and means for summing the temperature and pressure output signals and providing a combined output signal indicative of the combined effect of one of the output signals modified by the other of the output signals, the combined output signal being applied to energise the indicating means.

6. The apparatus of claim 5, wherein the summing means inverts the pressure output signal and adds that signal to the temperature output signal, the combined signal so generated being applied to a display of coolant temperature such that an abnormally high temperature is displayed when the pressure in the coolant system falls below a preset limit in relation to the temperature of the coolant.

7. A method of monitoring a status of a motor vehicle engine cooling system including the steps of:

a) sensing pressure and temperature of coolant in the cooling system and generating electrical input pressure and input temperature signals in response thereto respectively;

b) feeding at least one of the input pressure and input temperature signals to a signal calibrating circuit;

c) setting the calibrating circuit to calibrate a respective input signal at a set pressure and a set temperature;

d) generating at least one of a calibrated pressure output signal and a calibrated temperature output signal, the calibrated signals respectively being representative of the sensed pressure and temperature;

e) comparing the pressure and temperature output signals; and f) generating a compared output signal at least when the pressure of the coolant is below a coolant pressure limit in relation to the temperature of the coolant.

8. A method according to claim 7, including generating a warning signal to indicate a coolant system fault condition when the compared output signal has been generated.

9. A method according to claim 7, including generating a compared output signal when the pressure output signal exceeds a pressure output signal limit in relation to the temperature output signal.

10. A method according to claim 7, wherein the calibrating circuit is adjustable.

11. An apparatus for monitoring a status of a motor vehicle engine cooling system comprising:

a) means for sensing pressure and temperature of coolant in the cooling system and generating electrical input pressure and input temperature signals in response thereto, respectively;

b) means for feeding at least one of the input pressure and input temperature signals to a signal calibrating circuit;

c) means for generating at least one of a calibrated pressure output signal and a calibrated temperature output signal, the calibrated signals respectively being representative of the sensed pressure and temperature;

d) means for comparing the calibrated pressure and temperature output signals; and e) means for generating a compared output signal at least when the pressure of the coolant is below a coolant pressure limit in relation to the temperature of the coolant.

12. The apparatus of claim 11, wherein the indicating means includes warning means for generating a suitable warning signal when the relationship exceeds a predetermined limit.

13. The apparatus of claim 11, including means for immobilizing the engine, the cooling system status of which is being monitored, following a preset time interval after the pressure of the coolant has fallen below a preset limit in relation to the temperature of the coolant.

14. An apparatus according to claim 11, including means for generating a warning signal to indicate a coolant system fault condition when the compared output signal has been generated.

15. An apparatus according to claim 11, including means for generating a compared output signal when the pressure output signal exceeds a pressure output signal limit in relation to the temperature output signal.

16. An apparatus according to claim 11, wherein the calibrating circuit is adjustable.

17. An apparatus for monitoring the status of a motor vehicle engine cooling system comprising:

a) means for sensing the temperature of coolant in the cooling system and generating an electrical input temperature signal in response thereto;

b) means for feeding the input temperature signal to a calibrating circuit to generate a calibrated temperature output signal representative of the sensed temperature;

c) switch means for sensing the pressure of coolant in the cooling system and generating a first electrical input pressure signal when the pressure of the coolant is below a pressure value and a second electrical input pressure signal when the pressure of the coolant is above the pressure value, the pressure value being significantly above atmospheric and significantly below normal operating coolant pressure;

d) means for generating a desired pressure output signal in response to a selected one of the first and second electrical input pressure signals;

e) means for comparing the pressure and temperature output signals; and f) means for generating a compared output signal at least when there is a first electrical input pressure signal and the calibrated temperature output signal is representative of a temperature above a temperature limit.

18. An apparatus according to claim 17, wherein the compared output signal generating means generates a compared output signal when there is a second electrical input pressure signal and the calibrated temperature output signal is representative of a temperature above a temperature output signal limit.

* * * * *